US010421570B2

(12) United States Patent
Kristensen et al.

(10) Patent No.: US 10,421,570 B2
(45) Date of Patent: Sep. 24, 2019

(54) METHOD FOR PACKAGING OF AN ARTICLE OF MERCHANDISE

(71) Applicant: Signode Industrial Group LLC, Glenview, IL (US)

(72) Inventors: Alice Holm Kristensen, Sydals (DK); Tonny Konstmann, Nordborg (DK)

(73) Assignee: Signode Industrial Group LLC, Glenview, IL (US)

( * ) Notice: Subject to any disclaimer, the term of this patent is extended or adjusted under 35 U.S.C. 154(b) by 552 days.

(21) Appl. No.: 14/705,149

(22) Filed: May 6, 2015

(65) Prior Publication Data

US 2015/0321781 A1 Nov. 12, 2015

(30) Foreign Application Priority Data

May 7, 2014 (DE) ..... 10 2014 106 365

(51) Int. Cl.

| | |
|---|---|
| ***B65B 57/02*** | (2006.01) |
| ***B65B 9/06*** | (2012.01) |
| ***B65B 41/12*** | (2006.01) |
| ***B65B 61/06*** | (2006.01) |
| ***B65B 51/10*** | (2006.01) |

(Continued)

(52) U.S. Cl.

CPC ..... *B65B 57/02* (2013.01); *B65B 9/06* (2013.01); *B65B 9/13* (2013.01); *B65B 41/12* (2013.01); *B65B 51/10* (2013.01); *B65B 51/32* (2013.01); *B65B 57/04* (2013.01); *B65B 57/12* (2013.01);

(Continued)

(58) Field of Classification Search

CPC ..... B65B 9/13; B65B 9/06; B65B 41/12

See application file for complete search history.

(56) References Cited

U.S. PATENT DOCUMENTS

| | | | |
|---|---|---|---|
| 2,711,803 | A | 6/1955 | Hurst et al. |
| 2,745,688 | A | 5/1956 | Farrington et al. |

(Continued)

FOREIGN PATENT DOCUMENTS

| | | |
|---|---|---|
| CN | 101 830 292 | 9/2010 |
| DE | 2256753 | 5/1974 |

(Continued)

OTHER PUBLICATIONS

MSK—Packaging Systems GmbH, Opponent, Opposition Against German Patent No. 10 2014 106 365, Mar. 14, 2018, 26 pages (16 pages in German with 10 pages of machine translation).

(Continued)

*Primary Examiner* — Chelsea E Stinson

(74) *Attorney, Agent, or Firm* — Neal, Gerber & Eisenberg LLP

(57) ABSTRACT

The present disclosure provides a method for packaging an article of merchandise with a film material using a packaging apparatus. The film is a side-pleated tubular film roll. An input device receives the sole film packaging parameters of the thickness of the film, the width of the film, and the distance between a first side fold and a second side fold of the film. Based on these three film packaging parameters, a controller determines a specified length of the tubular film for packaging the article, and the packaging apparatus cuts off a segment of the tubular film having that specified length. The packaging apparatus then draws the segment of tubular film over the article being packaged.

22 Claims, 2 Drawing Sheets

(51) Int. Cl.

| | |
|---|---|
| ***B65B 51/32*** | (2006.01) |
| ***B65B 57/04*** | (2006.01) |
| ***B65B 57/12*** | (2006.01) |
| ***B65B 59/02*** | (2006.01) |
| ***B65B 9/13*** | (2006.01) |

(52) U.S. Cl.
CPC ..... *B65B 59/02* (2013.01); *B65B 61/06* (2013.01); *B65B 2210/04* (2013.01)

(56) References Cited

U.S. PATENT DOCUMENTS

| | | | | |
|---|---|---|---|---|
| 2,758,898 | A | 8/1956 | Kobsch | |
| 2,797,634 | A | 7/1957 | Rueckert | |
| 2,942,797 | A | 6/1960 | Lorenz et al. | |
| 3,016,869 | A | 1/1962 | Anderson et al. | |
| 3,190,457 | A | 6/1965 | Linden | |
| 3,278,059 | A | 10/1966 | Ridgeway et al. | |
| 3,436,046 | A | 4/1969 | Valeska | |
| 3,507,137 | A | 4/1970 | Taleff et al. | |
| 3,626,654 | A | 12/1971 | Hoffler et al. | |
| 3,679,244 | A | 7/1972 | Reddy | |
| 3,815,313 | A * | 6/1974 | Heisler | B65B 9/026 206/497 |
| 3,852,937 | A | 12/1974 | Bitsura et al. | |
| 3,866,386 | A * | 2/1975 | Ganz | B65B 11/10 53/134.1 |
| 3,902,303 | A | 9/1975 | King | |
| 3,944,045 | A | 3/1976 | Higgins | |
| 4,063,401 | A | 12/1977 | Higgins | |
| 4,067,174 | A | 1/1978 | Goldstein | |
| 4,204,377 | A | 5/1980 | Lancaster et al. | |
| 4,235,062 | A | 11/1980 | Lancaster, III et al. | |
| 4,317,322 | A | 3/1982 | Lancaster et al. | |
| 4,473,990 | A | 10/1984 | Thimon | |
| 4,587,796 | A | 5/1986 | Haloila | |
| 4,588,142 | A | 5/1986 | Malzacher | |
| 4,619,193 | A | 10/1986 | Crew | |
| 4,631,898 | A | 12/1986 | Brambilla | |
| 4,754,594 | A | 7/1988 | Lancaster | |
| 4,756,143 | A | 7/1988 | Lancaster | |
| 4,905,451 | A | 3/1990 | Jaconelli et al. | |
| 4,905,488 | A | 3/1990 | Plitt | |
| 4,914,891 | A | 4/1990 | Suolahti | |
| 4,939,989 | A | 7/1990 | Zacharias | |
| 5,107,657 | A | 4/1992 | Diehl et al. | |
| 5,140,795 | A | 8/1992 | Steding | |
| 5,154,382 | A | 10/1992 | Hoshino | |
| 5,195,297 | A | 3/1993 | Lancaster et al. | |
| 5,216,871 | A | 6/1993 | Hannen | |
| 5,463,843 | A | 11/1995 | Sharp | |
| 5,509,253 | A * | 4/1996 | Cappi | B65B 59/00 53/389.2 |
| 5,537,798 | A * | 7/1996 | Fukuda | B65B 9/20 53/168 |
| 5,619,838 | A | 4/1997 | Kasel | |
| 5,623,808 | A | 4/1997 | Franklin et al. | |
| 6,032,439 | A | 3/2000 | Birkenfeld et al. | |
| 6,237,307 | B1 | 5/2001 | Zentmyer et al. | |
| 6,298,636 | B1 | 10/2001 | Lachenmeier et al. | |
| 6,470,654 | B1 | 10/2002 | Lachenmeier et al. | |
| 6,516,591 | B1 | 2/2003 | Lancaster, III et al. | |
| 6,539,690 | B2 | 4/2003 | Alvarez | |
| 6,619,872 | B2 | 9/2003 | Crorey et al. | |
| 6,622,620 | B1 | 9/2003 | Byington | |
| 6,865,865 | B2 | 3/2005 | Hannen et al. | |
| 6,877,297 | B2 * | 4/2005 | Armington | B31D 5/0047 53/502 |
| 6,945,163 | B2 | 9/2005 | Squyres | |
| 7,036,289 | B2 | 5/2006 | Suolahti | |
| 7,040,076 | B2 | 5/2006 | Lachenmeier et al. | |
| 7,234,289 | B2 | 6/2007 | Hannen et al. | |
| 7,325,487 | B2 | 2/2008 | Squyres | |
| 7,367,740 | B2 | 5/2008 | Lazic et al. | |
| 7,533,515 | B1 | 5/2009 | Koskela | |
| 7,707,801 | B2 | 5/2010 | Lancaster, III | |
| 7,707,802 | B2 | 5/2010 | Forrest | |
| 7,908,831 | B1 | 3/2011 | Dugan | |
| 7,913,476 | B2 | 3/2011 | Lachenmeier | |
| 7,937,910 | B2 | 5/2011 | Jaconelli et al. | |
| 7,966,790 | B2 | 6/2011 | Michels et al. | |
| 7,975,456 | B2 | 7/2011 | Lachenmeier et al. | |
| 8,141,327 | B2 | 3/2012 | Lancaster, III | |
| 8,347,784 | B2 | 1/2013 | Herrmann | |
| 8,453,420 | B2 | 6/2013 | Schmidt et al. | |
| 8,875,480 | B2 | 11/2014 | Czok | |
| 2001/0046409 | A1 | 11/2001 | Fischer | |
| 2002/0033005 | A1 | 3/2002 | Lachenmeier et al. | |
| 2003/0156891 | A1 | 8/2003 | Hung et al. | |
| 2004/0107677 | A1 | 6/2004 | Hannen et al. | |
| 2006/0005511 | A1 | 1/2006 | Suolahti et al. | |
| 2006/0040085 | A1 | 2/2006 | Downs et al. | |
| 2006/0285915 | A1 | 12/2006 | Dellach et al. | |
| 2007/0157557 | A1 | 7/2007 | Lancaster, III | |
| 2007/0163207 | A1 | 7/2007 | Chiu Chen | |
| 2009/0217624 | A1 | 9/2009 | Forrest | |
| 2009/0229226 | A1 | 9/2009 | Beeland et al. | |
| 2009/0293425 | A1 | 12/2009 | Carter et al. | |
| 2010/0018165 | A1 | 1/2010 | Kudia | |
| 2010/0071317 | A1 | 3/2010 | Michels et al. | |
| 2010/0163443 | A1 | 7/2010 | Storig et al. | |
| 2010/0258241 | A1 | 10/2010 | Perecman | |
| 2011/0258973 | A1 | 10/2011 | Czok et al. | |
| 2013/0076753 | A1 | 3/2013 | Lancaster, III et al. | |
| 2013/0094790 | A1 * | 4/2013 | Garavaglia | B65D 75/002 383/207 |
| 2014/0013714 | A1 | 1/2014 | Lachenmeier et al. | |
| 2014/0053502 | A1 | 2/2014 | Pecchenini et al. | |
| 2014/0137516 | A1 | 5/2014 | Lachenmeier et al. | |
| 2014/0223863 | A1 | 8/2014 | Lancaster et al. | |
| 2014/0250831 | A1 | 9/2014 | Suolahti et al. | |
| 2015/0113920 | A1 | 4/2015 | Koskela et al. | |
| 2015/0232214 | A1 | 8/2015 | Suolahti et al. | |
| 2015/0251792 | A1 | 9/2015 | Koskela et al. | |

FOREIGN PATENT DOCUMENTS

| | | |
|---|---|---|
| DE | 3101310 | 12/1981 |
| DE | 3918311 | 12/1989 |
| DE | 3914595 | 11/1990 |
| DE | 20101909 | 6/2002 |
| DE | 102005037916 | 5/2006 |
| DE | 10 2005 062 603 | 7/2007 |
| DE | 20 2007 018 900 | 8/2009 |
| DE | 102010037770 | 6/2012 |
| DE | 10 2011 000 205 | 7/2012 |
| DE | 10 2012 024 176 | 6/2014 |
| EP | 0 621 184 | 10/1994 |
| EP | 0 653 352 | 5/1995 |
| EP | 0 811 554 | 12/1997 |
| EP | 1 033 305 | 9/2000 |
| EP | 1 097 867 | 5/2001 |
| EP | 1 266 828 | 12/2002 |
| EP | 1 266 829 | 12/2002 |
| EP | 1 454 827 | 9/2004 |
| EP | 1 542 192 | 6/2005 |
| EP | 1 574 432 | 9/2005 |
| EP | 1705119 A1 | 9/2006 |
| EP | 2 060 492 | 5/2009 |
| EP | 2 069 209 | 6/2009 |
| EP | 2 199 214 | 6/2010 |
| EP | 2 792 599 | 10/2014 |
| FI | 78433 | 4/1989 |
| FI | 91624 | 4/1994 |
| FR | 1 396 355 | 4/1965 |
| GB | 2 395 165 | 5/2004 |
| JP | 2002104308 | 4/2002 |
| JP | 2013154956 | 8/2013 |
| WO | 02/812065 | 2/2002 |
| WO | WO 2004/045952 | 6/2004 |
| WO | 2006/110596 | 10/2006 |
| WO | 2008/031449 | 3/2008 |
| WO | WO2009016464 A1 | 2/2009 |
| WO | 2010/078915 | 7/2010 |

(56) References Cited

FOREIGN PATENT DOCUMENTS

| | | |
|---|---|---|
| WO | 2012/027705 | 3/2012 |
| WO | WO2012058596 A1 | 5/2012 |
| WO | WO2015108963 A1 | 7/2015 |

OTHER PUBLICATIONS

MSK—Verpackungs-Systeme GmbH, Opponent, Opposition filed against corresponding European Patent Application No. 10 2014 106 365, Mar. 14, 2018, 16 pages (as translated from German into English by professional translation services).

MSK—Verpackungs-Systeme GmbH, Opponent, Statement of Facts and Grounds filed in Opposition against corresponding European Patent Application No. 10 2014 106 365, Jul. 17, 2018, 17 pages (as translated from German into English by professional translation services).

* cited by examiner

METHOD FOR PACKAGING OF AN ARTICLE OF MERCHANDISE

This application claims priority to and the benefit of German Patent Application No. 10 2014 106 365.1, filed on May 7, 2014, the entire contents of which are incorporated herein by reference.

The present disclosure relates to a method for packaging an article of merchandise with the aid of a film material, with the use of a packaging apparatus.

The term "packaging apparatus" in the present context is understood to mean in particular a banderole-type packaging apparatus or a cap-type packaging apparatus, which may be operated in either a so-called "cap stretching mode" or a so-called "cap shrinking mode." In a cap stretching mode of operation, the film is elastically stretched and is drawn over the article being packaged, so that the film is drawn forcibly against the article by means of the elastic tensile force. In a cap shrinking mode of operation, after the film is pulled over the article being packaged, the film is shrunken by heat-shrinkage.

In general, the film for such packaging methods is provided in the form of a side-pleated tubular film roll in the packaging apparatus. For the packaging, a segment is cut off from the side-pleated tubular film roll, is separated, and is drawn over the article being packaged. The packaging apparatus used for such packaging methods has input means and control means, to facilitate the operation, wherewith for packaging of an article film packaging parameters are entered into the input means and are then processed by the control means. Based on the film packaging parameters which have been entered, and other packaging parameters relating to the dimensions of the article being packaged and/or the dimensions of a pallet on which the article is mounted, the process of packaging the article is carried out, with the aid of data calculated by the control means. The term "film packaging parameters" in the following should be understood to mean parameters relating to the film and/or the side-pleated tubular film roll.

These film packaging parameters are entered by the operator of the packaging apparatus; they are based principally on values derived from the experience of the operator or on values pre-entered at the factory. Thus, when carrying out a cap stretching method, the operator must take into account how much extra film must be included in the film segment which is cut off so that the film is not damaged when it is stretched. When carrying out a cap shrinking method, the operator must take into account the fact that the film undergoes substantial shrinkage and thus an additional amount of film must be provided for. When carrying out a banderole packaging method, the operator must ensure that no excess film extends out at the upper end, so that in a case of doubt the amount of film that should be cut off should be reduced.

A drawback of these known packaging methods is that it is necessary to enter a number of film packaging parameters. Not only is this time-consuming, particularly if the dimensions of the articles to be packaged change frequently, but also if an erroneous value of a film packaging parameter is entered the quality of the packaging may be substantially adversely affected. The fact that an error has been made in entering a film packaging parameter might not be apparent from an immediate observation of the packaged article, but might only become visually evident at a subsequent time such as the time of shipping. Thus, a data entry error may lead to an imperfect sealing of the package, wherewith at a subsequent step moisture may reach the packaged article and damage it. In the case of banderole packaging, an error which leads to too much material at the top may cause the packaged article to fall over or slip.

A second drawback of the known packaging methods is that as a rule an excessive amount of film is used for packaging of each article. This results in excess consumption of film, and the need to change the side-pleated tubular film roll more often. Costs are increased due to greater film consumption and more idle time of the packaging apparatus.

Accordingly, there is a continuing need for a packaging method wherein film consumption is reduced, the packaging apparatus is rendered more operator-friendly, and at the same time the quality of the packaging is increased.

The packaging method of the present disclosure solves the above-described problems in that the sole film packaging parameters that are input into the input means are the thickness of the film, the width of the film, and the distance between a first side fold and a second side fold of the film. Thus, the operator is relieved from entering a large number of different parameters, but needs only to enter three film packaging parameters into the input means, namely the width of the film, the distance between the first side fold and the second side fold, and the thickness of the film. The term "distance between the side folds" in the present context is understood to mean the distance between the respective sharp edges of the V-shaped folds in the tubular film. In general, these two side folds face each other. Thereby even an operator who has no extensive experience can achieve optimal packaging of an article or merchandise, without excessive consumption of film and without negatively influencing the quality of the packaging. The requirement to enter these three film packaging parameters has been found to be particularly un-complicated, because the thickness of the film (e.g., 80 microns) is stated by the film manufacturer, and the operator can easily measure the width of the film and the distance between the side folds.

Advantageously, the width of the film is determined from the length of the side-pleated tubular film roll. This length, designated the "normal direction," can be easily and quickly determined by the operator. For this purpose, the operator only needs to measure the length of the cylindrical side-pleated tubular film roll, thus the distance between the two congruent lateral surfaces of the side-pleated tubular film roll. Alternatively, the length of the two side folds may be measured.

It is advantageous if the distance between the first side fold and the second side fold of the film is determined from the distance between a first side fold and a second side fold of the side-pleated tubular film. This distance can be determined rapidly and easily by the operator, because the distance in a side-pleated tubular film is apparent to the eye. The side folds can be easily identified because each has a superposed pair of double layers of film, i.e., a fourfold layer.

Then the control means determines the circumference of the film, based on the film packaging parameters which have been input; and the tubular film segment is cut off based on the circumference of the film. This has the advantage that the necessary length of the tubular film segment can be determined optimally based on the circumference as determined by the control means, wherewith one avoids cutting off too much film. No more film is cut off than the amount which the control means determines for the given article being packaged. In the determination by the control means, it is taken into account that the side folds comprise a fourfold layer of tubular film, and the segment of tubular film between the side folds has a double layer.

In this connection, it is particularly advantageous if the height of the article being packaged is measured by the packaging apparatus itself. This facilitates the use of the packaging method of the present disclosure for articles of different heights.

According to another embodiment of the packaging method of the present disclosure, the upper end of the cut-off tubular film is welded before the film is drawn over the article to be packaged, wherewith the time required for the welding is determined by the control means, based on the thickness of the film. Thus, a segment of tubular film in the form of a cap may be applied over the article being packaged, with the upper end of the segment being welded. This variant is a cap-type packing method. In order for the weld seam which is produced in this method to be robust, the welding time must be sufficiently long. Otherwise, the weld seam may be pulled apart, exposing the article being packaged to, e.g., moisture or soils. On the other hand, if the welding time is too long, the film will experience excessive thinning along the weld seam, with resulting low tolerance for stresses. As a result of the fact that it is no longer necessary to manually enter the required welding time (and to make multiple adjustments of same, also manually), appreciable amounts of time and film can be saved, since there is essentially no longer any wastage.

It may also be advantageous if the control means determines the cooling time required following the welding, and/or the temperature of the weld seam which is to be reached following the welding, based on the thickness of the film and/or the timing of the welding process. Because in the period shortly following the welding the weld seam is very fragile and unable to bear appreciable stresses, the seam must first be cooled to a certain temperature before the film is drawn over the article being packaged. Otherwise, the weld may fail, and the article may become exposed to moisture or soils. Further, the stability of the packaging may be jeopardized. In the past, it was necessary for the operator to perform the painstaking task of determining the cooling time following the welding, e.g., by experimentation or on the basis of experience gained over a period of years. This task is now performed by the control means so that, e.g., for a film thickness of 80 microns it may be determined that a welding time of 1.4 seconds is required. Additionally, the control means may also take into account the temperatures required for the welding elements that are to perform the welding. From the timing of the welding processes, it is possible to calculate how much the welding elements cool off between separate welding processes, and to adjust the welding time accordingly. For example, when the packaging apparatus is started up, the control means will establish a slightly longer welding time, and will reduce the welding time for subsequent welding processes. This allows maximum welding throughput with minimum consumption of film, and maximum quality of the packaging.

Advantageously, the packaging apparatus has an advancing element for cutting the tubular film segment to the proper length, wherewith a braking time and/or a run-over time of the advancing element is/are taken into account by the control means in the cutting to length of the tubular film segment. The advancing element is employed for cutting off the tubular film segment from the side-pleated tubular film roll. The advancing element may be comprised of roll means which rotate the side-pleated tubular film roll, thereby unwinding the film. Such advancing elements have a certain braking time and/or run-over time, so that known packaging apparatuses according to the prior art always cut off an excessive amount of film. If the control means takes into account the braking time and/or run-over time of the advancing elements, it is possible to further reduce the film consumption. In this connection, it is also conceivable to take into account different braking and/or run-over times which result from differences in electric power networks in different parts of the world, e.g., the difference between a 50 Hz network in Europe and a 60 Hz network in the USA.

It is advantageous if the control means for packaging of the article has access to data storage means, and the film packaging parameters which are input are processed with the aid of information which is (values which are) read out from the data storage means. Thus, the control means may read out all necessary values from the data storage means, resulting in very high quality of packaging along with minimal film consumption. In particular it is advantageous if the information is (values are) read out from the data storage means with reference to the film packaging parameters which have been entered and/or with reference to the height of the article. The values may be read out numerically from the data storage means with reference to the film packaging parameters which have been entered and/or with reference to the height of the article. This has the advantage that required data which cannot be directly calculated may be determined by the control means, e.g., by way of an iterative optimization process using the values provided from the databank. In this way, even values which can be optimally adjusted only based on years of operator experience can be determined by the control means, with resulting reduction in overall film consumption and with a very high quality of the resulting packaging.

It is advantageous if the input means has an operating surface which communicates with a control means of the packaging apparatus. This operating surface may in particular comprise a touch screen, providing a particularly convenient means of data input on a combined input means and display screen. This provides the advantage of an intuitive and user-friendly operating surface, facilitating error-free and wastage-free operation of the packaging apparatus even by inexperienced operators.

It is further advantageous if the operating surface provides access to a plurality of authorization levels. For example, it may be provided that the operator of the packaging apparatus is authorized only for input of film packaging parameters relating to the thickness of the film, the width of the film, and the distance between the first side fold and the second side fold of the film, while a servicing technician may have access to additional adjustments, which might even be unrelated to the packaging method itself.

Accordingly, it is advantageous if the packaging values are displayed by display means, and are changeable by input of information through the operating surface. In particular it is conceivable that the operator might not be required to enter the values for each instance, and instead may make small changes in the values, wherewith he may be provided with a "trimming function" whereby a value can be changed in one direction or another based on a starting value. It is also conceivable that means may be provided to adjust values which the control means has determined based on the entered film packaging parameters, e.g., parameters such as the welding time. Using the example of the welding time, means may be provided whereby the operator can reduce the determined welding time of 1.4 seconds to 1.2 seconds or raise it to 1.6 seconds. This may be needed, e.g., if upon startup the packaging apparatus has not been optimally adjusted to the ambient conditions. If the temperature of the surroundings is particularly high, a lower welding time may be required, compared to that required if the temperature of the surroundings is low. This situation can change during the course of the day.

In this connection, it is also conceivable that the "trimming" of the values is carried out not by entry of absolute values but instead the determined value may serve as a base value, with increases or decreases being implemented in relation to this base value.

Advantageously the operating surface provides access to a plurality of authorization levels, which are selectively made available. Thus, e.g., the operator may be provided with a particular heuristic and operator-friendly operating surface, whereas a service technician may be provided with a selectively different configuration of the operating surface, which offers wider adjustment possibilities for the packaging apparatus. This has the advantage of allowing intuitive operation of the packaging apparatus by the operator, because the operator will be able to enter only information needed for the packaging itself.

In the following, an exemplary embodiment of the invention will be described in more detail, with reference to the drawings, which are in the form of schematic depictions.

Figure 1:
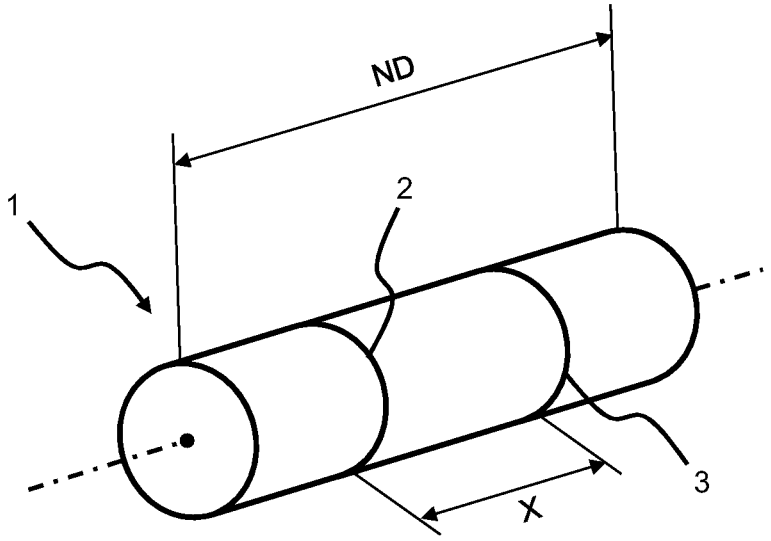
FIG. 1 illustrates a side-pleated tubular film roll, as delivered by a film manufacturer.
Figure 2:
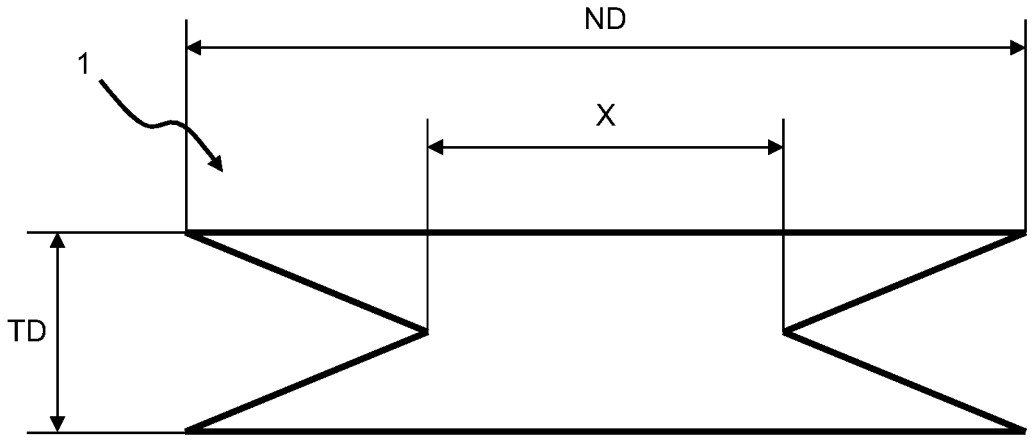
FIG. 2 illustrates a cross section through a slightly opened tubular film.

The operator may see from the label of the side-pleated tubular film 1 that the film thickness is, e.g., 80 microns. The operator enters this value for the packaging into his input means. The operator also determines the width of the film by measuring the length ND (ND="normal direction") of the side-pleated tubular film roll 1. The operator enters this value as well into his input means. Further, the operator determines the distance between the first side fold 2 and the second side fold 3 of the tubular film by measuring the distance X between the first side fold and the second side fold of the side-pleated tubular film roll 1. The operator also enters this value into his input means, at which point he has provided all the information necessary for the packaging. The control means then calculates from these data the width of the film, TD (TD=transverse direction), as TD=ND−X. For example, if the operator measures ND=950 mm and X=430 mm in size, then the calculated value TD=520 mm (see. FIG. 2). The control means determines, from the film packaging parameters entered, the values required for the packaging, and displays these values to the operator, who may adjust or "trim" the values, if necessary or desirable.

Thus, e.g., a display will appear which informs the operator of the welding time, which was determined by the control means based on the value of the film thickness which the operator entered. The welding time may be, e.g., 1.4 seconds, wherewith the operator will be allowed to change this value within predetermined limits, e.g., by 0.2 seconds (or e.g., 20%) upward or downward. It is also conceivable that the operator may be allowed only a relative adjustment, thus e.g., the absolute welding time might not be displayed, but instead a "trimming function" might be provided. For example, the welding time may be represented by an output value of "0", which may be adjusted, e.g., in the range +1 to −1.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method for packaging an article using a roll of side-pleated tubular film, said method comprising:

receiving, by an input device and from an operator, a plurality of film packaging parameters including: (1) a thickness of the tubular film, (2) a width of the tubular film, and (3) a distance between a first side fold of the tubular film and a second side fold of the tubular film;

determining, by a controller, a designated length based on: (1) one or more of the thickness of the tubular film, the width of the tubular film, and the distance between the first side fold of the tubular film and the second side fold of the tubular film; and (2) one or more values stored in a database;

cutting a segment of tubular film having the designated length off of the roll of side-pleated tubular film; and drawing the segment of tubular film over the article.

2. The method of claim 1, wherein determining the designated length includes determining, by the controller, a length of a perimeter of the tubular film using the width of the tubular film and the distance between the first and second side folds of the tubular film.

3. The method of claim 1, which includes measuring a height of the article.

4. The method of claim 1, which includes welding an upper end of the segment of tubular film before drawing the segment of tubular film over the article to be packaged.

5. The method of claim 4, which includes determining, by the controller, a time required for the welding based on the tubular film thickness.

6. The method of claim 4, which includes determining, by the controller, a required post-welding cooling time based on at least one of the tubular film thickness and the time required for the welding.

7. The method of claim 4, which includes determining, by the controller, a temperature of a weld seam that is to be reached following the welding based on at least one of the tubular film thickness and the time required for the welding.

8. The method of claim 1, wherein cutting the segment of tubular film includes cutting the segment of tubular film via an advancing element of a packaging apparatus, wherein the controller takes into account at least one of a braking time and a run-over time of the advancing element in association with the cutting.

9. The method of claim 1, wherein determining the designated length includes accessing, by the controller, information stored in a data storage device.

10. The method of claim 9, wherein the information is associated with at least one of: (1) one or more of the received film packaging parameters, and (2) a height of the article.

11. The method of claim 10, wherein the information includes one or more numerical values.

12. The method of claim 1, which includes displaying, by a display device, the plurality of received film packaging parameters.

13. The method of claim 1, which includes enabling input of first information when an authorization level is a first authorization level and enabling input of second different information when an authorization level is a second different authorization level.

14. The method of claim 1, wherein the thickness of the tubular film, the width of the tubular film, and the distance between the first side fold of the tubular film and the second side fold of the tubular film are the only received film packaging parameters.

15. The method of claim 1, further comprising determining, by the controller, the designated length based on: (1) the thickness of the tubular film, the width of the tubular film, and the distance between the first side fold of the tubular film and the second side fold of the tubular film; and (2) the one or more values stored in a database.

16. A packaging system comprising:

a packaging apparatus configured to cut a segment of tubular film off of a roll of side-pleated tubular film, said segment having a designated length, and to draw the segment of tubular film over an article to be packaged;

an input device configured to receive, from an operator, a plurality of film packaging parameters including: (1) a thickness of the tubular film, (2) a width of the tubular film, and (3) a distance between a first side fold of the tubular film and a second side fold of the tubular film; and a controller configured to determine the designated length based on: (1) one or more of the thickness of the tubular film, the width of the tubular film, and the distance between the first side fold of the tubular film and the second side fold of the tubular film; and (2) one or more values stored in a database.

17. The packaging system of claim 16, which includes the roll of side-pleated tubular film.

18. The packaging system of claim 16, wherein the controller is configured to determine the designated length in part by determining a circumference of the tubular film from the received plurality of film packaging parameters.

19. The packaging system of claim 16, which includes a welder configured to weld an upper end of the segment of tubular film before drawing the segment of tubular film over the article to be packaged.

20. The packaging system of claim 19, wherein the controller is configured to determine a time required for the welding based on the tubular film thickness.

21. The packaging system of claim 16, wherein the thickness of the tubular film, the width of the tubular film, and the distance between the first side fold of the tubular film and the second side fold of the tubular film are the only received film packaging parameters.

22. The packaging system of claim 16, wherein the controller is configured to determine the designated length based on: (1) the thickness of the tubular film, the width of the tubular film, and the distance between the first side fold of the tubular film and the second side fold of the tubular film; and (2) the one or more values stored in a database.

* * * * *